United States Patent [19]

Beyer

[11] Patent Number: 4,747,591

[45] Date of Patent: May 31, 1988

[54] APPARATUS FOR SEPARATING FOLDED PERFORATED REEL PAPERS

[75] Inventor: Jörg-Detlef Beyer, Ortsteil Eichede, Fed. Rep. of Germany

[73] Assignee: Riensch & Held (GmbH & Co.), Hamburg, Fed. Rep. of Germany

[21] Appl. No.: 106,235

[22] Filed: Oct. 7, 1987

Related U.S. Application Data

[63] Continuation-in-part of Ser. No. 863,108, May 14, 1986, abandoned.

[30] Foreign Application Priority Data

May 22, 1985 [DE] Fed. Rep. of Germany ..... 3518386

[51] Int. Cl.[4] ..... B61H 41/00; B26F 3/00

[52] U.S. Cl. ..... 270/52.5; 270/21.1; 83/205; 83/278; 83/423; 83/648; 225/103

[58] Field of Search ..... 270/39–40, 270/58, 52.5, 21.1, 95; 493/357, 356, 414, 413, 40, 41, 324, 46; 225/103, 101, 93; 400/621; 83/660, 205, 278, 423, 648; 271/150, 151

[56] References Cited

U.S. PATENT DOCUMENTS

| | | | |
|---|---|---|---|
| 2,177,722 | 10/1939 | Josephs | 270/41 |
| 2,761,676 | 9/1956 | Sabee et al. | 270/39 |
| 2,832,823 | 9/1974 | Currie | 270/58 X |
| 3,669,442 | 6/1972 | Thomas | 270/58 |
| 3,794,228 | 2/1974 | Colwill et al. | 225/93 |
| 3,883,131 | 5/1975 | Anderson, Jr. et al. | 493/416 X |
| 3,924,845 | 12/1975 | Wise et al. | 270/58 |
| 4,022,332 | 5/1977 | Freakes et al. | 271/150 |
| 4,093,204 | 6/1978 | Landgraf et al. | 493/324 |
| 4,312,502 | 1/1982 | Wilt | 271/151 |
| 4,325,277 | 4/1982 | Uchida et al. | 83/205 |
| 4,408,775 | 10/1983 | Meier | 270/39 X |
| 4,449,435 | 5/1984 | Colditz | 83/262 X |
| 4,508,527 | 4/1985 | Uno | 493/357 |

FOREIGN PATENT DOCUMENTS

| | | | |
|---|---|---|---|
| 2499040 | 8/1982 | France . | |
| 1369893 | 11/1974 | United Kingdom | 270/39 |
| 2073716 | 10/1981 | United Kingdom . | |

*Primary Examiner*—Eugene H. Eickholt
*Attorney, Agent, or Firm*—Thomas S. Baker, Jr.

[57] ABSTRACT

The apparatus for separating folded and perforated or creased endless or reel papers, which form an uninterrupted stack, comprises a conveyor belt 9 conveying the same to a separating station, in order to permit an automatic separation of the stack into individual stacks *7a* with a predetermined number of paper sheets. For this purpose, a separating sword 2 is moved preferably from below between the sheets of the stack, so that a stack *7a* is formed with the desired number of individual sheets. The small cavity 10 running in the longitudinal direction and formed by the separating sword 2 is used for receiving a knife 4, which is moved at right angles over the stack, in order to separate the same at a perforation or fold. Pivotable removal bolts 1 are used for conveying away the separated stack *7a* and for transfer to a second conveyor belt 5. The removal bolts 1 are then moved back into the starting position, so that the separating sword 2 can be extended out of the conveying area of the stack and a new separating process can be carried out. This permits an automatic separation into small stacks with predetermined numbers at virtually any random point.

38 Claims, 2 Drawing Sheets

Figures 1, 2:
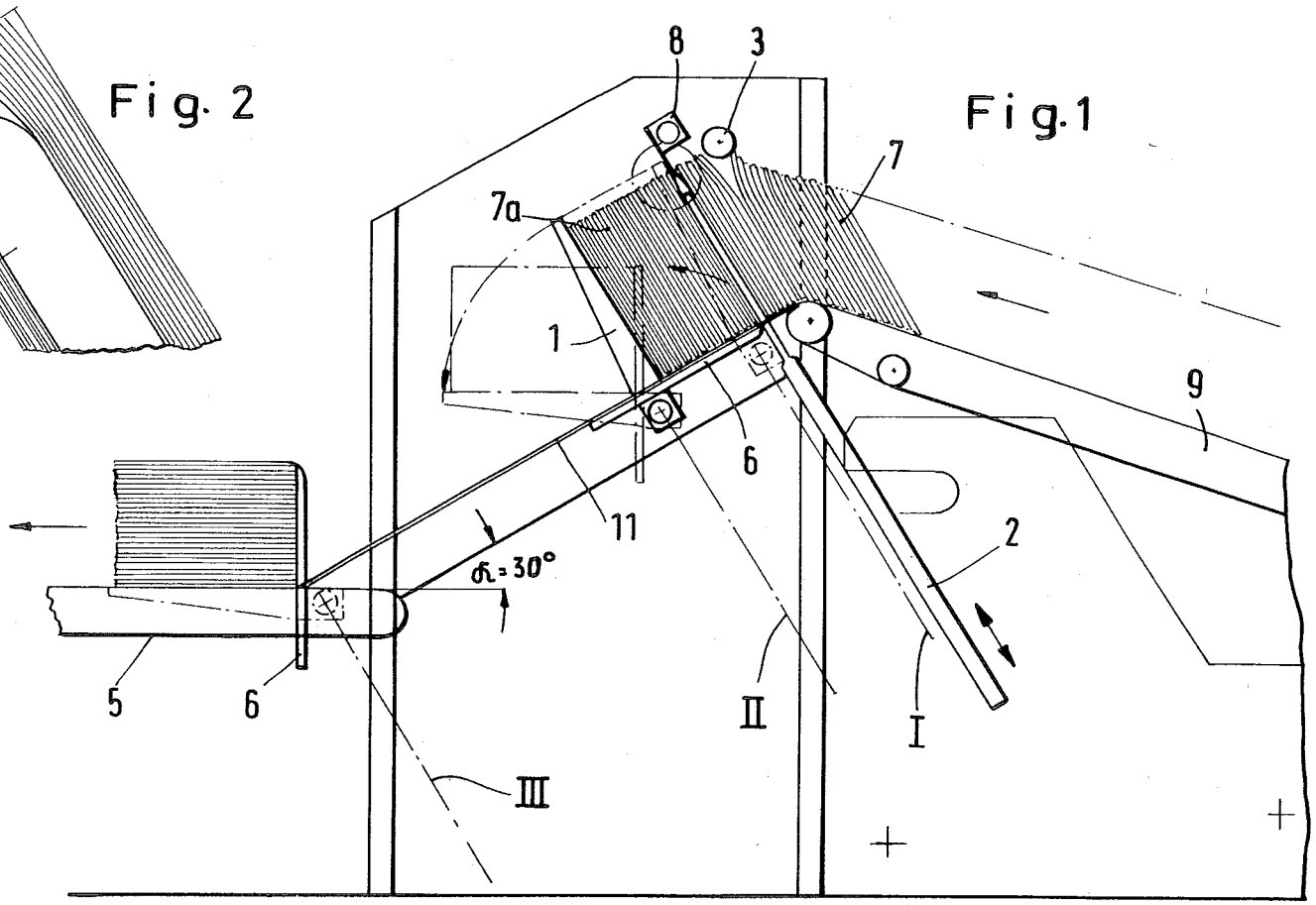

1
2
3
4
5
6
7
7a
8
9
10
11
I
II
III
α = 30°

APPARATUS FOR SEPARATING FOLDED PERFORATED REEL PAPERS

This application is a continuation-in-part of copending U.S. patent application having Ser. No. 06/863,108 filed May 14, 1986 and now abandoned.

The invention relates to an apparatus for separating folded and perforated endless or reel papers with a conveying means, on which the reel papers are conveyed standing on their folded edges to a further processing means.

This apparatus is used for the processing of a reel paper formed by folding with a corresponding perforation or by creasing a corresponding stack. The individual papers are printed, folded, perforated or creased in an upstream apparatus. Optionally several layers with interposed carbon paper are superimposed. A continuous stack with the corresponding individual papers passes out of the printing and creasing machine. The reel papers are conveyed in standing manner to a further processing means, i.e. the edges formed by the creases or perforations stand on the conveyor. "Standing" does not necessarily mean that they are precisely vertical. However, the conveying of the reel papers does not take place horizontally. Normally the folds or creases are alternately at the top and bottom. In order to be able to pack the papers in predetermined numbers, e.g. (1000, 2000, 3000), etc., it is necessary to separate the continuous stacks in a corresponding manner at the perforation or crease.

British Pat. No. 1 369 893 discloses an apparatus, in which separation takes place immediately after the formation of the endless stack, i.e. on forming the latter, before the latter is completed. Separation takes place before many creased reel papers are superimposed. Following onto the separation, the separated stack is conveyed away horizontally, in the manner in which it is compiled. Separation takes place by a flat table to whose edge associated with the fold or crease to be separated is fixed a knife. At said knife, which is stationary during said separation, several wheels move past, in order to produce a relative movement between knife and wheel and consequently ensure the cutting through at the fold or crease made just beforehand.

The problem of the invention is to provide an apparatus of the aforementioned type, in which the separation takes place automatically independent of the location of the production of the stack and whilst simultaneously ensuring a reliable conveying away of the separated stack.

This problem is solved in that in the vicinity of the conveying means between the reel papers of the stack a separating sword is moved into the vicinity of the corresponding perforation, that into the cavity formed by the separating sword can be inserted a knife movable at right angles over the stack in the direction of the perforation and that the separating sword supports the following stack until the separated stack is completely conveyed away.

In the inventive apparatus the finished, compiled stack of reel papers is conveyed to the actual separating means standing on the creases. On receiving a corresponding counting pulse, the separating sword is moved between the papers, so that the latter are separated. In the conveying direction upstream of the sword, a stack is then formed having the desired number of grouped papers or sheets. The separating sword is moved into the vicinity of the adjacent crease or the corresponding perforation, so that at this point a cavity is formed which passes through at right angles to the conveying direction. The knife is then inserted in this cavity in the manner of a letter opener and is moved through the same. The knife is relatively blunt, so that an effective separation at the perforation is ensured. Due to the fact that the separating sword supports the following stack until the separated stack has been completely conveyed away, it is ensured that said conveying away can be carried out without difficulty and impediment and that the following sheets and papers are supported for this time by the separating sword.

The apparatus can also be constructed in the manner described in claims 2 to 6. The use of a removing bolt movable and pivotable in the conveying direction constitutes a particularly advantageous embodiment in order to handle the relatively unstable, separated stack and to supply same to a further processing means.

The separating sword is supplied from below, i.e. from below the conveying means, which is then formed by several parallel endless belt members. In this case the separating sword is constituted, as defined in claim 7, by several blades, said blades passing through the gaps left by the belt members.

The invention is described in greater detail hereinafter relative to an embodiment and the attached drawings, wherein show:

FIG. 1 a diagrammatic side view of an embodiment of an apparatus according to the invention.

FIG. 2 a detail of circled area of FIG. 1 on a larger scale.

Figure 3:
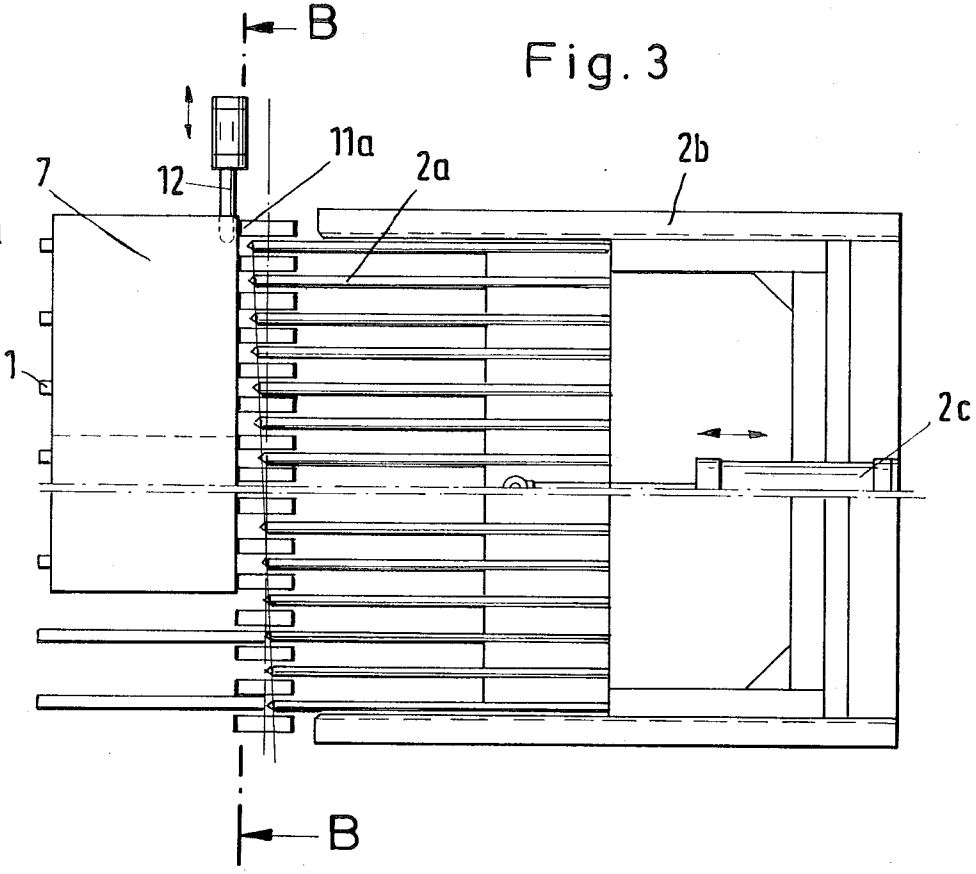

FIG. 3 a top view of FIG. 1.

Figure 4:
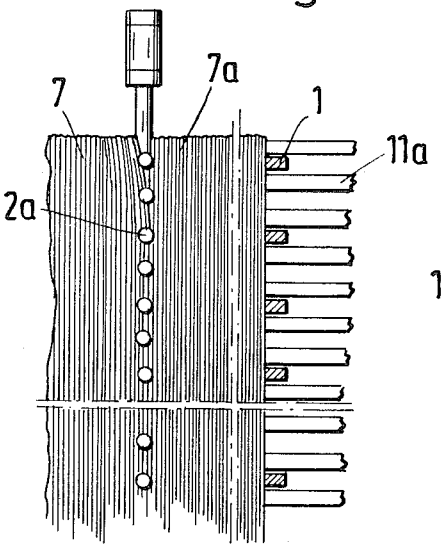

FIG. 4 a section B—B through FIG. 3.

The apparatus shown in the drawing only gives the part in which the previously folded and perforated paper is grouped and separated into individual stacks. Thus, this part of the apparatus can be set up as an independent unit at any random point, i.e. also where perforation and folding does not take place.

The apparatus comprises a first conveyor belt 9, which receives a stack 7 of reel paper from an upstream, not shown machine, e.g. a printing press. Stack 7 comprises zig-zag-folded papers, which are perforated in the folds, optionally of several layers of different paper types. The folds with the perforation are alternately positioned at the top and bottom, so that the papers stand on the first conveyor belt 9, which slopes slightly upwards. At its end, i.e. at its highest point, the first conveyor belt 9 passes into a downwardly sloping conveying plane In principle, the stack can move as a result of its own weight on this downwardly inclined conveying plane. To facilitate this movement, this conveying plane is formed by revolving, endless belt members 11*a*, but they are not driven. These belt members run around not shown pulleys, which are mounted in easy action manner and consequently permit an unimpeded downwards stack movement when free for such a movement.

The actual separating device is located at the transfer point. This device comprises a separating sword 2, which can be moved up and down, and a cutting device 8 with a knife 4. Details are given in FIG. 2. There is also an opening knife 12 (cf. FIGS. 3 and 4), which does not cut and instead merely so opens the stack that easier penetration of the separating sword is possible.

In the vicinity of the conveying plane 11 are provided a plurality of removal bolts 1, each with a tilt back 6 directed at right angles with respect to the conveying direction. The removal bolts 1 and associated tilt backs 6 are fixed to a conveying chain and are moved up and down by the latter in conveying plane 11, as will be described hereinafter. As is clear from observing 3 and 4, the conveying plane is formed by the belt members 11*a*, which are spaced. This spacing permits the passage of the separating sword, the removal bolt 1 and the tilt backs 6. Removal bolt 1 and tilt backs 6 can also be pivoted in the manner indicated in dot-dash lines in FIG. 1. At the end of the conveying plane 6, i.e. at the point up to which the removal bolts 1 and tilt backs 6 can be moved downwards, a second conveyor belt 5 starts, which is substantially horizontal and leads to a further processing means.

It becomes clear from consideration of FIG. 3 that the separating sword 2 comprises several blades 2*a*. The separating sword is guided by guides 2*b*. The pneumatic cylinder for moving the separating sword is designated 2*c*. This FIG. 3, which essentially constitutes a plan view of the plane in which the separating sword is movable also makes it clear that the tips of the blades 2*a* are arranged in displaced manner in the conveying direction, i.e. the tip of blade 2*a* closest to opening knife 12 is furthest forwards or upwards, i.e. said tip penetrates the stack first. In order to facilitate this penetration, the opening knife 12 is provided.

In operation the stack 7 from the not shown printing and folding machine is transferred to the first conveyor belt 9. A continuous stack is formed from a correspondingly large number of sheets. This stack is conveyed standing on the folds through the first belt 9 to the highest point and therefore the separating plane. On reaching the latter, the removal bolts 1 are ready and the first sheet located at the front in the conveying direction passes into engagement with said removal bolts 1. Coinciding with the conveying speed of the first conveyor belt 9, the removal bolts 1 in conveying plane 11 slope downwards in the conveying direction until the corresponding number of sheets is present in the stack 7*a* to be separated. The removal bolts 1 pass through the gaps between the endless belts 11*a*. The endless belts 11*a*, which are movable with a very easy action, but are not driven, ensure the reliable movement of the sheets on said conveying plane. The sheets can be counted, so that corresponding counting pulses are available for initiating the following working steps. Thus, the opening knife 12 is advanced to the desired point for opening the stack, as is more particularly shown in FIG. 4. The separating sword with its furthest advanced blade 2*a* is inserted in the thus produced gap. The movement of the separating sword 2 into its completely advanced position then takes place in an unhindered manner, said position being shown by the continuous lines in FIG. 1. The separating sword leaves at the top an elongated cavity 10 free (FIG. 2), into which can be introduced the relatively blunt knife 4, controlled by the separating device 8. The knife is moved at right angles over the stack, i.e. in conveying plane 11, but perpendicular to the conveying direction, so that the stack is cleanly separated. The knife is then moved back into its starting position. The removal bolts 1 are then pivoted together with their tilt backs 6 into the position shown in dot-dash line in FIG. 1. Simultaneously the removal bolts 1 and the associated tilt backs with the separated stacks 7*a* located thereon are moved by the conveyor chain in conveying plane 11 downwards into the vicinity of the second conveyor belt 5 and the transfer of the separated stack thereto takes place at this point. The removal bolts with their tilt backs are then moved back into the starting position (tilt backs 6 parallel to the conveying plane 11).

A relative movement is still possible between the removal bolts and the tilt backs in the conveying plane 11, so that the tilt backs always have a "length" such as corresponds to the stack 7*a* present. The thicker the stack 7*a*, the greater the "length" of the tilt back.

When the removal bolts 1 have again reached their highest position, the separating sword 2 can be retracted, so that a new stack 7*a* can be compiled in the upper part of the conveying plane and the repeat process is repeated.

The movement of the removal bolts 1 with the tilt backs 6 from position I into position II (FIG. 1) takes place at the speed of the first conveyor belt 9. The movement from position II into position III and back into position I takes place very rapidly, because during said movement the separating sword 2 prevents a further advance of stack 7. However, this is possible because the stack 7 has a corresponding elasticity. If in certain circumstances this is not possible, it must be ensured that during the "absence" of the removal bolts, the separating sword 2 is also moved in the conveying direction at the speed of conveyor belt 6. The removal or transfer time is, as stated, normally so short that there is no need for such an additional movement possibility for separating sword 2.

Examination of FIG. 2 makes it clear that the separating sword 2 leaves at the top an elongated cavity 10, into which can be inserted the relatively blunt knife 4 and it can then be advanced at right angles to the conveying direction for performing the actual cutting process. Knife 4 is relatively blunt, so that cutting takes place at the perforation and not at another point.

Opening knife 12 is an auxiliary device which is intended to facilitate the first penetration of blades 2*a* of separating sword 2. There is no need for this opening knife if it can be obviated as a result of the technical circumstances.

In place of the freely revolving belt members 11*a* with gaps for blades 2*a* and removal bolts 1, it is also possible to provide fixed rails, provided that it is ensured that the movement of the separated stacks 7*a* in the downwards direction is unimpeded and takes place with corresponding reliability and security.

I claim:

1. Apparatus for providing a separated stack from a main stack of folded and perforated reel papers comprising a conveying means on which the reel papers are conveyed standing on their folded edge to a further processing means in the vicinity of the conveying means, a separating sword, means for moving the separating sword between the reel papers of the stack to thereby form a cavity, a blade mounted over the stack, means for moving the blade into the cavity at right angles to the direction of the perforations, and means for retaining the separating sword to support the following stack until the separated stack has been conveyed away.

2. Apparatus according to claim 1, characterized in that a means for carrying the separated stack is provided, said carrying means includes a removal bolt, said removal bolt is movable parallel to the plane of the separating sword between an initial and a final position and carries in the conveying direction the stack portion separated from the main stack and wherein the separating sword remains in its separating position until the removal bolt has moved from the final position into its initial position in the plane of the separating sword.

3. Apparatus according to claim 2, characterized in that the removal bolt includes a pivot such that the bolt is pivotable to thereby tilt the separated stack.

4. Apparatus according to claim 3, characterized in that to the removal bolt includes a tilt back, which is generally perpendicular to the removal bolt.

5. Apparatus according to claim 1, characterized in that the conveying means includes a first conveyor belt which conveys the folded and perforated stack to the separating sword, a downwardly inclined conveying plane for grouping the separated stack following the first conveyor belt and a substantially horizontally directed second conveyor belt for removing the separated stack from the downwardly inclined plane.

6. Apparatus according to claim 2, characterized in that the conveying means includes a first conveyor belt which conveys the folded and perforated stack to the separating sword, a downwardly inclined conveying plane for grouping the separated stack following the first conveyor belt for removing the separated stack from the downwardly inclined plane.

7. Apparatus according to claim 3, characterized in that the conveying means includes a first conveyor belt which conveys the folded and perforated stack to the separating sword, a downwardly inclined conveying plane for grouping the separated stack following the first conveyor belt and a substantially horizontally directed second conveyor belt for removing the separated stack from the downwardly inclined plane.

8. Apparatus according to claim 4, characterized in that the conveying means includes a first conveyor belt which conveys the folded and perforated stack to the separating sword, a downwardly inclined conveying plane for grouping the separated stack following the first conveyor belt and a substantially horizontally directed second conveyor belt for removing the separated stack from the downwardly inclined plane.

9. Apparatus according to claim 3, characterized in that the removal bolt with the tilt back is movable over the conveying plane into the vicinity of the second conveyor belt and wherein the removal bolt may be pivoted from a position parallel to the separating sword into the plane of the second conveyor belt.

10. Apparatus according to claim 4, characterized in that the removal bolt with the tilt back is movable over the conveying plane into the vicinity of the second conveyor belt and wherein the removal bolt may be pivoted from a position parallel to the separating sword into the plane of the second conveyor belt.

11. Apparatus according to claim 5, characterized in that the removal bolt with the tilt back is movable over the conveying plane into the vicinity of the second conveyor belt and wherein the removal bolt may be pivoted from a position parallel to the separating sword into the plane of the second conveyor belt.

12. Apparatus according to claim 1, characterized in that the separating sword comprises a plurality of blades having tips that are mutually displaced in the conveying direction.

13. Apparatus according to claim 2, characterized in that the separating sword comprises a plurality of blades having tips that are mutually displaced in the conveying direction.

14. Apparatus according to claim 3, characterized in that the separating sword comprises several blades having tips that are mutually displaced in the conveying direction.

15. Apparatus according to claim 4, characterized in that the separating sword comprises a plurality of blades having tips that are mutually displaced in the conveying direction.

16. Apparatus according to claim 5, characterized in that the separating sword comprises a plurality of blades having tips that are mutually displaced in the conveying direction.

17. Apparatus according to claim 5, characterized in that the conveying plane is formed by freely revolving belts, a gap between the belts through which the removable bolts may be moved.

18. Apparatus according to claim 1, characterized in that an opening knife for opening the stack is positioned laterally of the separating sword wherein the sword may be inserted easily into the stack.

19. Apparatus according to claim 2, characterized in that an opening knife for opening the stack is positioned laterally of the separating sword wherein the sword may be inserted easily into the stack.

20. Apparatus according to claim 3, characterized in that an opening knife for opening the stack is positioned laterally of the separating sword wherein the sword may be inserted easily into the stack.

21. Apparatus according to claim 4, characterized in that laterally alongside the separating sword is provided an opening knife for opening the stack, so that the sword can be more satisfactorily and reliably inserted in the stack.

22. Apparatus according to claim 5, characterized in that laterally alongside the separating sword is provided an opening knife for opening the stack, so that the sword can be more satisfactorily and reliably inserted in the stack.

23. Apparatus according to claim 6, characterized in that laterally alongside the separating sword is provided an opening knife for opening the stack, so that the sword can be more satisfactorily and reliably inserted in the stack.

24. Apparatus according to claim 7, characterized in that laterally alongside the separating sword is provided an opening knife for opening the stack, so that the sword can be more satisfactorily and reliably inserted in the stack.

25. Apparatus according to claim 8, characterized in tha laterally alongside the separating sword is provided an opening knife for opening the stack, so that the sword can be more satisfactorily and reliably inserted in the stack.

26. Apparatus according to claim 9, characterized in that laterally alongside the separating sword is provided an opening knife for opening the stack, so that the sword can be more satisfactorily and reliably inserted in the stack.

27. Apparatus according to claim 10, characterized in that laterally alongside the separating sword is provided an opening knife for opening the stack, so that the sword can be more satisfactorily and reliably inserted in the stack.

28. Apparatus according to claim 11, characterized in that laterally alongside the separating sword is provided an opening knife for opening the stack, so that the sword can be more satisfactorily and reliably inserted in the stack.

29. Apparatus according to claim 12, characterized in that laterally alongside the separating sword is provided an opening knife for opening the stack, so that the sword can be more satisfactorily and reliably inserted in the stack.

30. Apparatus according to claim 13, characterized in that laterally alongside the separating sword is provided an opening knife for opening the stack, so that the sword can be more satisfactorily and reliably inserted in the stack.

31. Apparatus according to claim 14, characterized in that laterally alongside the separating sword is provided an opening knife for opening the stack, so that the sword can be more satisfactorily and reliably inserted in the stack.

32. Apparatus according to claim 15, characterized in that laterally alongside the separating sword is provided an opening knife for opening the stack, so that the sword can be more satisfactorily and reliably inserted in the stack.

33. Apparatus according to claim 16, characterized in that laterally alongside the separating sword is provided an opening knife for opening the stack, so that the sword can be more satisfactorily and reliably inserted in the stack.

34. Apparatus according to claim 17, characterized in that laterally alongside the separating sword is provided an opening knife for opening the stack, so that the sword can be more satisfactorily and reliably inserted in the stack.

35. Apparatus according to claim 18, characterized in that laterally alongside the separating sword is provided an opening knife for opening the stack, so that the sword can be more satisfactorily and reliably inserted in the stack.

36. Apparatus according to claim 19, characterized in that laterally alongside the separating sword is provided an opening knife for opening the stack, so that the sword can be more satisfactorily and reliably inserted in the stack.

37. Apparatus according to claim 20, characterized in that laterally alongside the separating sword is provided an opening knife for opening the stack, so that the sword can be more satisfactorily and reliably inserted in the stack.

38. Apparatus according to claim 5, characterized in that the conveying plane includes a plurality of spaced adjacent revolving belts, and wherein said removal bolt may project through said spaces.

* * * * *